US008973569B2

(12) United States Patent
Padgett et al.

(10) Patent No.: US 8,973,569 B2
(45) Date of Patent: Mar. 10, 2015

(54) GAS BURNER

(75) Inventors: Michael Padgett, Austin, KY (US); Bruce Sheaves, Adams, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 980 days.

(21) Appl. No.: 12/706,103

(22) Filed: Feb. 16, 2010

(65) Prior Publication Data

US 2010/0206293 A1 Aug. 19, 2010

Related U.S. Application Data

(60) Provisional application No. 61/153,514, filed on Feb. 18, 2009.

(51) Int. Cl.

| | |
|---|---|
| ***F24C 3/00*** | (2006.01) |
| ***F24C 15/10*** | (2006.01) |
| ***F23D 14/06*** | (2006.01) |
| ***F24C 3/10*** | (2006.01) |

(52) U.S. Cl.

CPC ..... *F23D 14/06* (2013.01); *F23D 2900/14062* (2013.01); *F23D 2900/14063* (2013.01)

USPC ..... 126/39 E; 126/39 H; 126/39 R; 431/191

(58) Field of Classification Search

USPC ..... 126/39 E, 39 H, 39 R; 431/278, 191, 266, 431/284, 354, 283, 268, 114; 239/558, 561

See application file for complete search history.

(56) References Cited

U.S. PATENT DOCUMENTS

| | | | | |
|---|---|---|---|---|
| 5,842,849 | A | 12/1998 | Huang | |
| 6,035,846 | A * | 3/2000 | Saleri | 126/39 H |
| 6,132,205 | A | 10/2000 | Harneit | |
| 6,322,354 | B1 | 11/2001 | Carbone et al. | |
| 6,325,619 | B2 | 12/2001 | Dane | |
| 7,001,176 | B2 | 2/2006 | Bettinzoli | |
| 7,096,887 | B2 | 8/2006 | Tupa et al. | |
| 7,291,009 | B2 | 11/2007 | Kamal et al. | |
| 8,245,703 | B2 * | 8/2012 | Cadeau et al. | 126/39 E |
| 2005/0142511 | A1 * | 6/2005 | Yam et al. | 431/285 |
| 2005/0178450 | A1 * | 8/2005 | Tupa et al. | 137/625.47 |
| 2006/0121402 | A1 * | 6/2006 | Bettinzoli | 431/354 |
| 2007/0141521 | A1 | 6/2007 | Armanni | |
| 2008/0202495 | A1 * | 8/2008 | Caloca Galindo et al. | 126/39 E |
| 2009/0165777 | A1 * | 7/2009 | Cadima et al. | 126/39 E |
| 2011/0186037 | A1 * | 8/2011 | Ryu et al. | 126/39 K |

FOREIGN PATENT DOCUMENTS

| | | | |
|---|---|---|---|
| CN | 1896595 | 1/2007 | |
| EP | 0634608 | 1/1995 | |
| FR | 2650369 | 2/1991 | |
| FR | 2650369 A1 * | 2/1991 | F23D 14/06 |
| WO | 2006005428 | 1/2006 | |
| WO | 2008116773 | 10/2008 | |

OTHER PUBLICATIONS

International Search Report for PCT/US2010/024353, dated Jun. 11, 2010, 3 pages.

* cited by examiner

*Primary Examiner* — Avinash Savani
*Assistant Examiner* — Vivek Shirsat
(74) *Attorney, Agent, or Firm* — Pearne & Gordon LLP

(57) ABSTRACT

A gas burner for a cooking appliance includes at least one combustion chamber with a first gas inlet forming a substantially annular outer flame ring and a substantially annular inner flame ring. At least one flame channel is configured to trigger ignition of at least one of the inner flame ring and outer flame ring. In one example, at least one transfer burner port is in gas-flow communication with the combustible gas in the at least one combustion chamber.

9 Claims, 7 Drawing Sheets

GAS BURNER

CROSS-REFERENCE TO RELATED APPLICATIONS

This application claims the benefit of U.S. Provisional Application No. 61/153,514, filed Feb. 18, 2009, the entire disclosure of which is hereby incorporated herein by reference.

FIELD OF THE INVENTION

The present invention relates generally to gas burner devices used in appliances, and more particularly, to a gas burner that provides multiple flame rings.

BACKGROUND OF THE INVENTION

Gas burners such as gas surface burners, for example, that are used with domestic gas ranges typically include a burner body or head that includes a plurality of burner ports through which a combustible gas is distributed to the exterior of the burner body. A burner cap can be provided at the top of the burner body so as to close off the interior of the burner body to the escape of the combustible gas. Usually a mixing conduit introduces a mixture of a gaseous fuel and air as the combustible gas into the burner body. The gas-air mixture can be confined in combustible gas plenum within the burner body that is closed off by the burner cap. From the plenum, the combustible gas typically passes through the burner ports and is ignited by an igniter and burned. Often times the burner body has a circular configuration so that a ring of discrete flames emanating from the burner ports is established. The gaseous fuel typically comprises natural gas (which is primarily methane), propane, butane or mixtures thereof.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a gas burner for a cooking appliance is provided, comprising a burner body comprising a first combustion chamber with a first gas inlet and a second combustion chamber with a second gas inlet. The first and second combustion chambers are separate and are independently supplied with combustible gas via the first and second gas inlets, respectively. The first and second combustion chambers cooperate to form a substantially annular outer flame ring and a substantially annular inner flame ring. An electric igniter is configured to ignite the inner and outer flame rings, and a plurality of flame channels are disposed between the first and second combustion chambers. Each of the flame channels includes at least one transfer burner port in gas-flow communication with the combustible gas in one of the first and second combustion chambers.

In accordance with another aspect of the present invention, a gas burner for a cooking appliance is provided, comprising a burner body comprising at least one combustion chamber with a first gas inlet forming a substantially annular outer flame ring and a substantially annular inner flame ring. A simmer burner is separate from the at least one combustion chamber and is independently supplied with combustible gas via a second gas inlet, the simmer burner forming a simmer flame ring. An electric igniter is disposed between the inner flame ring and the simmer flame ring, and is configured to ignite at least one of the simmer flame ring and the inner flame ring. At least one flame channel includes at least one transfer burner port in gas-flow communication with the combustible gas in the at least one combustion chamber and is configured to trigger ignition of the outer flame ring.

In accordance with another aspect of the present invention, a gas burner for a cooking appliance is provided, comprising a burner body comprising a first combustion chamber with a first gas inlet and a second combustion chamber with a second gas inlet. The first and second combustion chambers are separate and are independently supplied with combustible gas via the first and second gas inlets, respectively. The first and second combustion chambers form a substantially annular outer flame ring and a substantially annular inner flame ring. First and second burner caps close off a top of each of the first and second combustion chambers, respectively, so as to substantially preclude the escape of combustible gas therefrom. A plurality of flame channels are disposed between the first and second combustion chambers and are configured to trigger ignition of at least one of the inner and outer flame rings. The first and second burner caps are configured to provide an upper opening for each of the plurality of flame channels.

Unless otherwise specified, "a," "an," "the," and "at least one" are used interchangeably and mean one or more than one. Also herein, the recitations of numerical ranges by endpoints include all numbers subsumed within that range (e.g., 1 to 5 includes 1, 1.5, 2, 2.75, 3, 3.80, 4, 5, etc.). It is understood that all spatial references, such as "horizontal," "vertical," "top," "upper," "lower," "bottom," "left," and "right," are for illustrative purposes only and can be varied within the scope of the disclosure.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
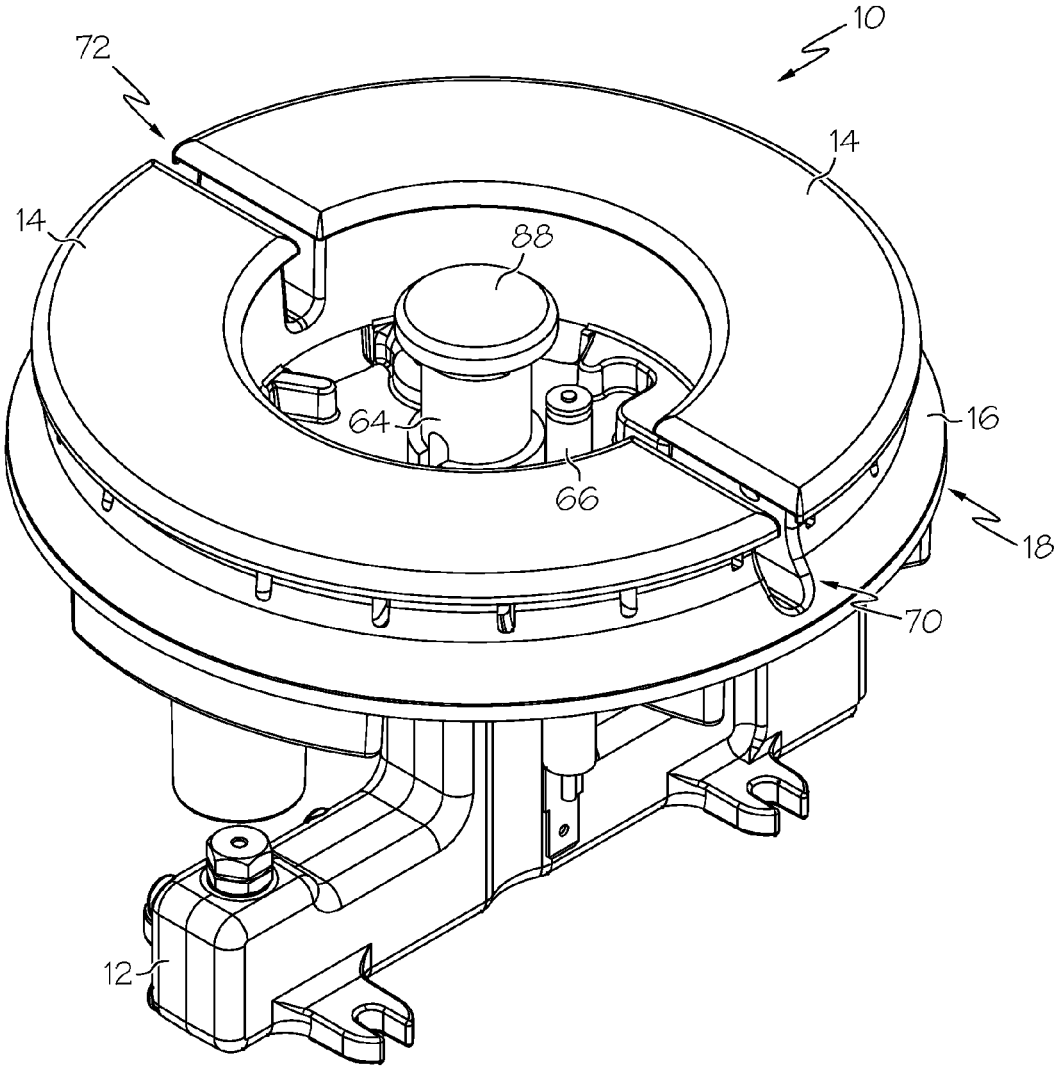
FIG. 1 provides a top perspective view of a gas burner.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, a gas burner for a cooking appliance, such as a gas cooktop, range, etc. is illustrated. FIG. 1 provides a top perspective view of a gas burner 10 positioned atop a mounting base 12. The mounting base 12 positions the gas burner 10 on a cooktop, and aligns the gas burner 10 with the gas lines and igniter that are used during operation of the gas burner 10. The gas burner 10 provides a structure that mixes gaseous fuel with air to create a combustible mixture. Preferably, the gas burner 10 mixes the gaseous fuel and the air fairly evenly to provide hot and efficient combustion.

Figure 2:
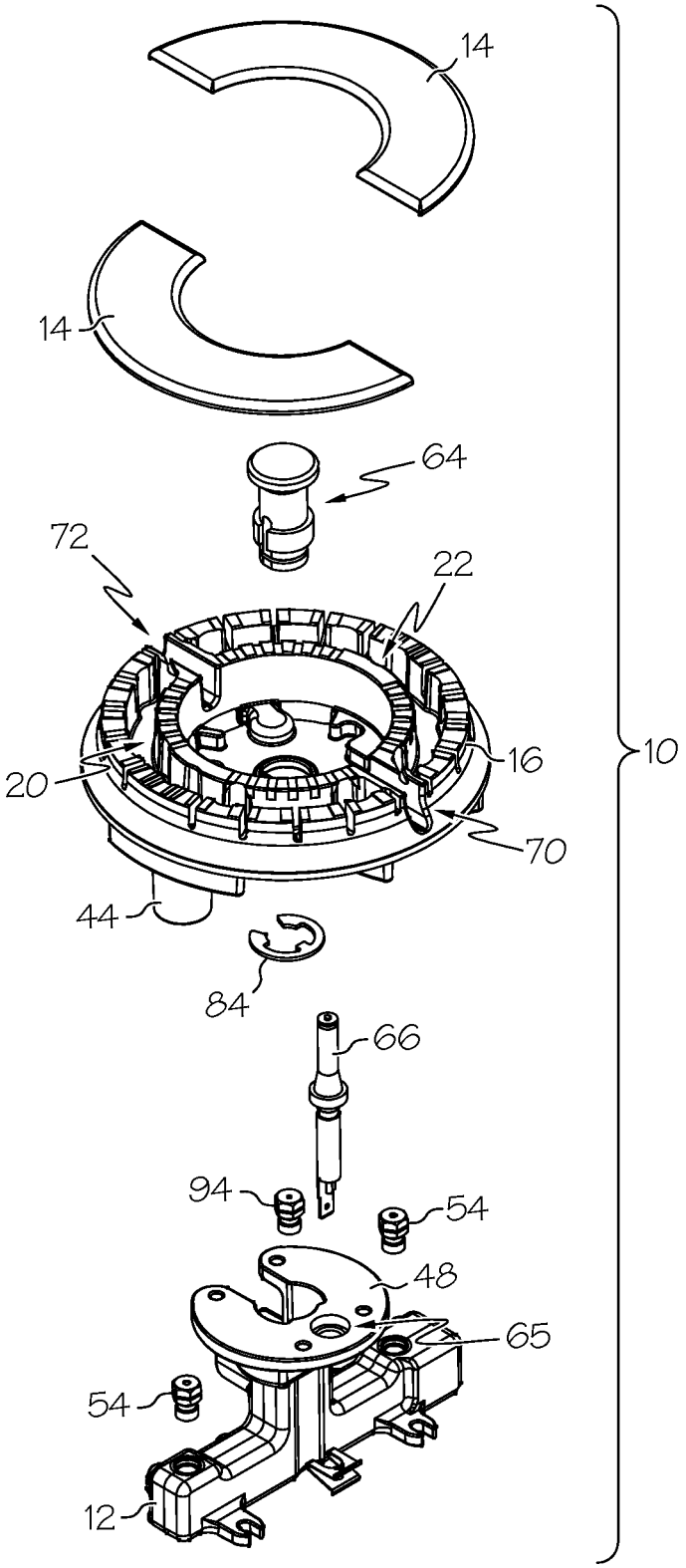
FIG. 2 provides an exploded top perspective view of the gas burner.

The gas burner 10 is shown in greater detail in FIG. 2, which provides an exploded top perspective view of the gas burner 10 including a plurality of burner caps 14, a burner body 16, and a mounting base 12. The burner caps 14 rests on top of the burner body 16 and inhibit, such as prevent, loss of gaseous fuel from the top of the burner body 16 and provides a closed, aesthetically appealing surface for the top of the burner body 16 that deters spillage of food or liquids into the burner body 16 itself.

The burner body 16 is shown in greater detail in the remaining Figures. The burner body 16 includes a burner base 18 that is generally annular (e.g. washer-shaped), and has bottom side 19 with a generally flat portion for resting upon the cooktop. In some examples, the burner base 18 can be angled upwards by providing increased thickness on the sides thereof, which can help direct airflow along the outside of the gas burner 10.

The burner body 16 can be fabricated from a variety of suitable materials such as carbon steel, brass, or aluminum, with aluminum being preferred. However, any other suitable material such as cast iron, ceramics, or even heat-resistant plastics can be used, so long as the material used is capable of withstanding the temperatures resulting from the operation of the burner for an extended period of time and over numerous thermal cycles. The burner body 16 can be fabricated using die casting or any other suitable method known to those skilled in the art.

The burner body 16 can further include at least one combustion chamber, such as a first combustion chamber 20 and a second combustion chamber 22, though various numbers of combustion chambers can be provided. The first and second combustion chambers 20, 22 can be separate from each other, such as by being spaced a distance apart or even by sharing a common separating wall. The first and second combustion chambers 20, 22 can be independently supplied with combustible gas via a first gas inlet 24 and a second gas inlet 26, respectively (see FIG. 6). Additionally, each of the combustion chambers 20, 22 can be provided with independent burner caps 14, or can even be provided with a singular cap covering both. The combustion chambers 20, 22 can be generally hollow curved or angled regions extending generally around a perimeter of the burner body 16 where gaseous fuel and air mix and combustion occurs. In one example, a plurality of combustion chambers can curve along the burner body 16 along an angle equal to or greater than about 30°. In another example, a plurality of combustion chambers can curve along the burner body 16 along an angle equal to or greater than about 100°. In the shown example, the first and second combustion chambers 20, 22 can each curve along the burner body 16 along an angle equal to about 180°. Still, it is understood that the various combustion chambers can extend along various angles, which can be the same or different from each other.

One the of the combustion chambers will now be described in detail, with the understanding that such description can also apply to any other combustion chamber. Still, any of the combustion chambers can be identical, similar, or even different. The first combustion chamber 20 can include an inner wall 30 is positioned on one side along the combustion chamber 20, and an outer wall 32 positioned on other side of the combustion chamber 20, to form a curved fuel/air channel 34 between the inner wall 30 and the outer wall 32. The inner wall 30 and the outer wall 32 thus provide a curved structure or a "tube-in-tube" structure. The height of the inner wall 30 and the outer wall 32 should typically be the same so that the fuel/air channel 34 becomes closed upon placing the burner cap 14 upon the burner body 16. However, the heights may differ if the burner cap 14 is designed to fit over walls having different heights while still closing off the fuel/air channel 34.

Both of the inner wall 30 and the outer wall 32 include a plurality of fuel exit ports, or burner ports 36, 38, respectively. The burner ports 36, 38 are apertures in the inner wall 30 and outer wall 32 that allow gaseous fuel within the fuel/air channel 34 to exit from the fuel/air channel 34 and enter respective combustion zones where it mixes with air or any other suitable oxygen source. The number of burner ports 36, 38 can vary in different embodiments of the invention; however, sufficient burner ports 36, 38 should be provided to both encourage the even mixing of gaseous fuel with air and to allow sufficient gaseous fuel to enter the combustion zones to provide the desired level of heating. For example, about 20-30 burner ports 36, 38 can be used for each of the inner and outer walls 30, 32.

As shown, the first and second combustion chambers 20, 22 are arranged to provide two combustion zones, an inner combustion zone 40 and an outer combustion zone 42. Thus, the burner ports 36, 38 can be provided in the first and second combustion chambers 20, 22 through which combustible gas can pass therefrom to be combusted in the inner and outer zones 40, 42, respectively. The inner zone 40 can be defined generally within the bounds of the inner walls 30 of the first and second combustion chambers 20, 22, while the outer zone 42 can be defined generally outside the bounds of the outer walls 32 of the first and second combustion chambers 20, 22. Thus, the inner and outer zones 40, 42 can be arranged generally as concentric combustion zones, with the outer zone 42 having a generally greater perimeter than the inner zone 40. For example, as shown, the inner burner ports 36 of the first and second combustion chambers 20, 22 can cooperate for form a substantially annular inner flame ring within the inner zone 40, and the outer burner ports 38 of the first and second combustion chambers 20, 22 can cooperate for form a substantially annular outer flame ring within the outer zone 42. The inner and outer flame rings can be concentric. It is understood that the substantially annular inner and outer flame rings can be formed by a single combustion chamber, or as shown, can be formed by a cooperating plurality of combustion chambers. Still, the burner ports 36, 38 can cooperate to form various flames having various geometries that extend about various portions of the burner body 16, etc.

As shown, the inner burner ports 36 forms an "internal flame" or inner flame ring during operation of the gas burner 10 in which the flames converge towards a central point within the inner combustion zone 40. Additionally, the outer burner ports 38 forms an "outer flame" or outer flame ring during operation of the gas burner 10 in which the flames extend into the outer combustion zone 42 and away from the gas burner 10. Providing both inner and outer burner ports 36, 38 can increase the amount of combustion and thus heat energy that the gas burner 10 can provide.

The burner ports 36, 38 can be any passage that allows fuel to enter the combustion zones 40, 42 from the fuel/air channel 34. For example, the burner ports 36, 38 can be grooves, such as small channels, positioned in the top region of the inner and outer walls 30, 32 that extend downward into a portion of the inner and outer walls 30, 32. In one example, the burner ports 36, 38 can be generally straight channels running through the inner wall 30. In another example, the burner ports 36, 38 can be aligned and/or angled relative to the center of the combustion chamber. By aligned, it is meant that the burner ports 36, 38 are all oriented in the same direction relative to the inner wall 30. For example, if one of the burner ports 36, 38 passes through the inner wall 30 at an angle of about 15 degrees in one direction, all of the burner ports 36, 38 will pass through the inner wall 30 at about 15 degrees in one direction. Angling the burner ports 36, 38 can direct the flames inwards, outwards, upwards, and/or downwards, and/or even encourage the gaseous fuel to swirl upon entering the combustion zone(s) 40, 42, as desired. The burner ports 36, 38 can be angled to a variety of different degrees relative to the center of the burner body 16, in any single axis or combination of axes.

The burner ports 36, 38 can be provided in a variety of shapes. For example, the burner ports 36, 38 can be circular tunnels passing through the inner wall 30. Another shape suitable for the burner ports 36, 38 are grooves positioned in the top region of the inner wall 30. The grooves are small channels that extend downward into a portion of the inner wall 30 from the top of the wall. Grooves provide the advantage of being somewhat easier to clean than other types of fuel exit ports if the burner body 16 is removed from the cooking appliance, as they can be readily accessed by removing the burner cap 14. When a burner cap 14 is placed over the burner body 16, the top of the grooves will be covered so that the grooves form tunnels that serve as burner ports 36, 38. The burner ports 36, 38 can vary in diameter in different embodiments, based on the desired level of gaseous fuel flow to the combustion zone(s) 40, 42. For example, the inner burner ports 36 can be generally smaller than the outer burner ports 38, such that the inner flame ring provides generally less heat than the outer flame ring. In another example, the inner burner ports 36 can be provided generally closer together, while the outer burner ports 38 can be provided generally farther apart. The burner ports 36, 38 can be arranged evenly, non-evenly, random, in a pattern or array, etc. Still, various configurations are contemplated.

The burner body 16 also includes one or more gas entry holes in each fuel/air channel 34, such as the gas inlet 24, 26 provided to each of the first and second combustion chambers 20, 22, respectively. The gas inlet 24 is one or more openings positioned within the fuel/air channel 34 that pass through the burner base 18 to allow gaseous fuel to enter the fuel/air channel 34. The gas inlet 24 has a diameter sufficient to allow the ready passage of gaseous fuel into the fuel/air channel 34. For example, the gas inlet 24 may have a diameter equal to the width of the fuel/air channel 34. The number and positioning of gas inlet(s) 24 can vary in different embodiments. For example, as shown, there is one gas inlet 24, 26 positioned within the fuel/air channel 34 of each of the first and second combustion chambers 20, 22.

Figure 4:
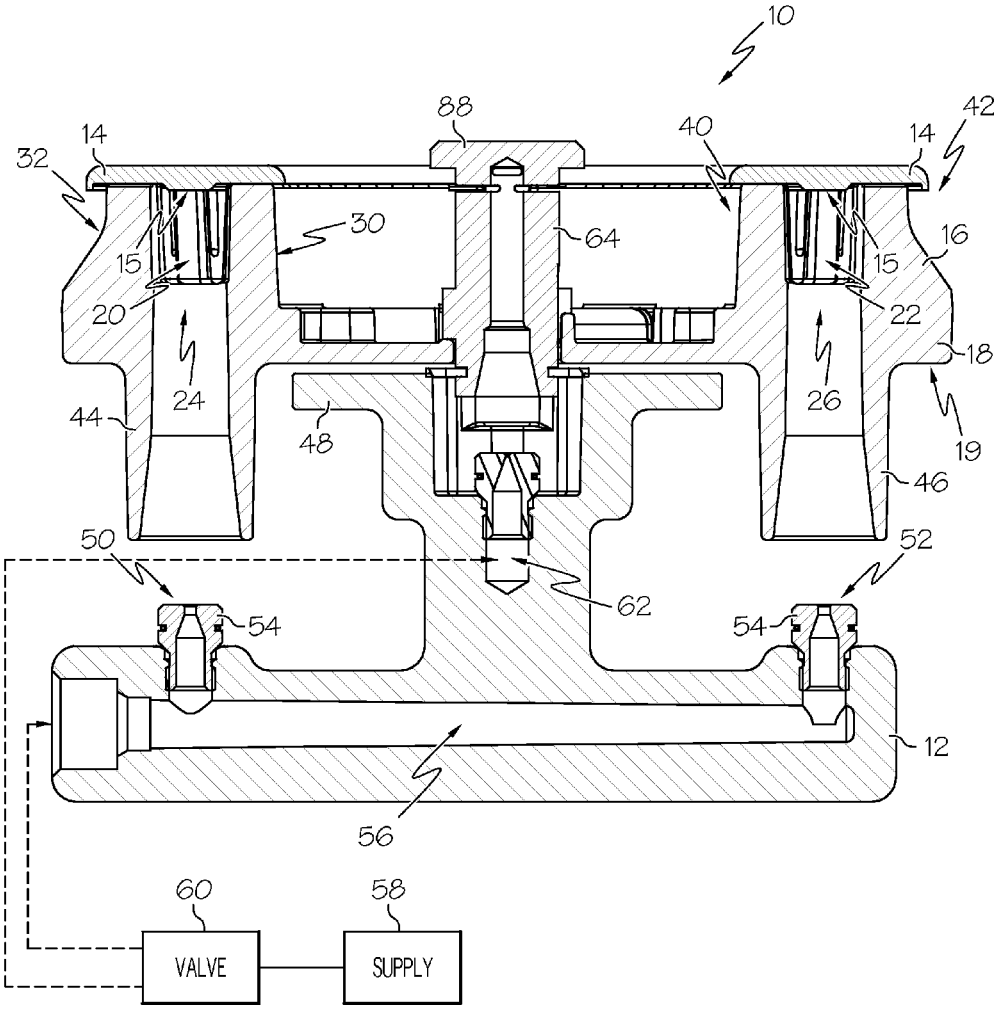
FIG. 4 provides a sectional view taken along line 4-4 of FIG. 3 of the gas burner.

As shown in FIG. 4, burner body 16 also includes one or more gas entry tubes 44, 46, which can be Venturi tubes, positioned under the first and second gas inlets 24, 26 and extending downward from the bottom side 19 of the burner base 18. The gas entry tubes 44, 46 are conduits for gaseous fuel that are positioned underneath the gas inlets 24, 26 to independently channel gaseous fuel from gas lines to the fuel/air channel 34 of each combustion chamber 20, 22. The gas entry tubes 44, 46 are thus hollow structures that can transfer gaseous fuel. A variety of shapes can be used for the gas entry tubes 44, 46. For example, they can be hollow cylinders, as shown. The gas entry tubes 44, 46 should have a length sufficient for the gas entry tubes 44, 46 to extend near gas supply port(s) of the mounting base 12.

As previously described, the gas burner 10 also includes a burner cap 14 configured to fit over the fuel/air channel 34 of each of the first and second combustion chambers 20, 22. Preferably, a plurality of burner caps 14 are provided to independently cover each of the first and second combustion chambers, though a single cap can also be used to cover multiple chambers. The burner cap 14 typically has a geometry corresponding to that of the chamber, such as curved or angled, having an inner edge and an outer edge that it fits over the inner wall 30 and the outer wall 32, while including a curved opening similar to that of the inner zone 40. The outer edge of the burner cap 14 can also include a flange that extends over the upper edge of the outer wall 32 and/or inner wall 30 to help retain the burner cap 14 in place over the burner body 16. The burner cap 14 can be formed from any suitable material capable of withstanding the temperatures resulting from the operation of the burner body 16 for an extended period of time and over numerous thermal cycles. For example, the burner cap 14 can be formed of steel, and prepared by stamping or sintering of metal powder. The burner cap 14 can simply rest upon the surface of the burner body 16, or if desired it can be further secured by attachment. The cap can include a raised undersurface 15 that is configured as shown that seats in a complementary fashion between the inner and outer walls etc. so as to substantially preclude the passage of the combustible gas out of the fuel/air channel 34. The burner cap 14 can be supported around its entire perimeter, and the raised undersurface maintains it in place on the burner body 16 so it cannot accidentally slide off the burner body 16.

The burner body 16 can be mounted directly to the surface of a cooktop. If mounted in this fashion, gas lines will be installed such that they provide fuel to the burner body 16 through the gas entry tubes 44, 46. However, another embodiment of the gas burner 10 is provided with a mounting base 12 to support the gas burner 10 on a cooking appliance. The mounting base 12 can provide various functions such as supporting the gas burner 10 above a surface within the heating region of a cooking appliance (e.g., a range cooktop), facilitating air entry into the gas burner 10, aligning the gas burner 10 with the one or more gas lines, and/or simplifying the removal of the burner body 16 for cleaning. The mounting base 12 includes a securing plate 48 with a planar surface that supports the gas burner 10 and provides various attachment points for attachment to the gas burner 10 and the cooking appliance. Typically, the mounting base 12 is attached under the surface of the cooktop using screws or other connecting devices that connect with one or more attachment points. The burner body 16 can then be coupled to the mounting base 12 instead of directly to the surface of a cooktop. The mounting base 12 can be formed of a suitable material such as aluminum, ceramic, or stainless steel, with aluminum being preferred, and can be formed by die casting, for example.

As shown in FIG. 4, the mounting base 12 also includes one or more gas supply ports 50, 52 positioned and sized near the gas entry tubes 44, 46 of the burner body 16. For example, the gas supply ports 50, 52 can be provided with nozzles 54 to direct the gas into the gas entry tubes 44, 46. Each of the gas supply ports 50, 52 can be in fluid communication with a first gas supply plenum 56 provided in the mounting base 12 that receives the gas from a gas supply 58 (e.g., a gas line, etc.) via an adjustable valve 60. The adjustable valve 60, shown schematically for clarity, can be adjustable by a user to control the amount of gas flow to the burner body 16, which can allow selective adjustment of the flame size. In one example, the adjustable valve 60 can be a dual outlet gas valve for controlling the supply of gas to plurality of burners, such as that described in U.S. Pat. No. 7,096,887, which is incorporated herein by reference. For example, the dual outlet gas valve 60 can allows different rates of gas flow therethrough so that relatively high and relatively low flames may be selectively applied to the plurality of burners in several alternative modes of operation. With selective adjustment the dual outlet gas valve 60, the first and second outlets of the dual outlet valve can individually be provided with a low flow, high flow, intermediate flow, or a closed operating state, etc. For example, as shown, the dual outlet gas valve 60 can have a first outlet in communication with the first gas supply plenum 56 providing fuel to the first and second combustion chambers 20, 22, and can also have a second outlet in communication with a second gas supply plenum 62 of the mounting base 12 providing fuel to another combustion chamber, such as for a simmer burner 64 as will be discussed more completely herein.

The mounting base 12 can also include various other features, such as an igniter aperture 65 positioned and sized to retain an igniter 66. For example, the igniter 66 can be retained within the igniter aperture 65 by a threaded connection. Still, the igniter 66 can also be coupled directly to the burner body 16. The igniter 66 can be disposed variously. In one example, the igniter 66 can be disposed about the inner combustion zone 40 of the burner body 16 to ignite the inner flame ring. In another example, the igniter 66 can be disposed about the outer combustion zone 42, such as about the burner base 18, to ignite the outer flame ring. Gas burner igniters are known in the art; for example, various types of electronic ignition systems such as a spark ignition system can be used. For example, the igniter 66 can be located adjacent to either or both of the inner burner ports 36 (e.g., the inner flame ring) and/or simmer burner 64 so as to ignite either or both. In another example, the igniter 66 can be located adjacent to the outer burner ports 38 (e.g., the outer flame ring) for ignition thereof. In addition or alternatively, the igniter 66 can be electrically coupled (e.g., via contact and/or via mechanical fasteners, threaded connection, etc.) to the mounting base 12, which can in turn be electrically coupled to the appliance (e.g., via contact and/or via mechanical fasteners, etc.) to provide an electrical ground path to the electrical power supply (not shown) for the igniter 66. For example, an example igniter may operate at relatively high voltage, such as 14,000 volts, and an established electrical ground path can help to protect the various other electronics (e.g., controls, displays, etc.) of the appliance.

It is to be understood that the igniter 66 can trigger ignition of any or all of the inner flame ring, outer flame ring, and simmer flame ring, and in various orders. It is further understood that the igniter 66 can directly trigger ignition of any or all of the inner flame ring, outer flame ring, and simmer flame ring, or can indirectly trigger ignition, such as from one flame ring to another. It is further understood that only a portion of a particular flame ring may be burning when the ignition of another flame ring occurs. For example, while the igniter 66 can be configured to trigger ignition of the outer flame ring subsequent to ignition of the inner flame ring, only a portion of the inner flame ring may be burning when the ignition of the outer flame ring is triggered.

Figure 6:
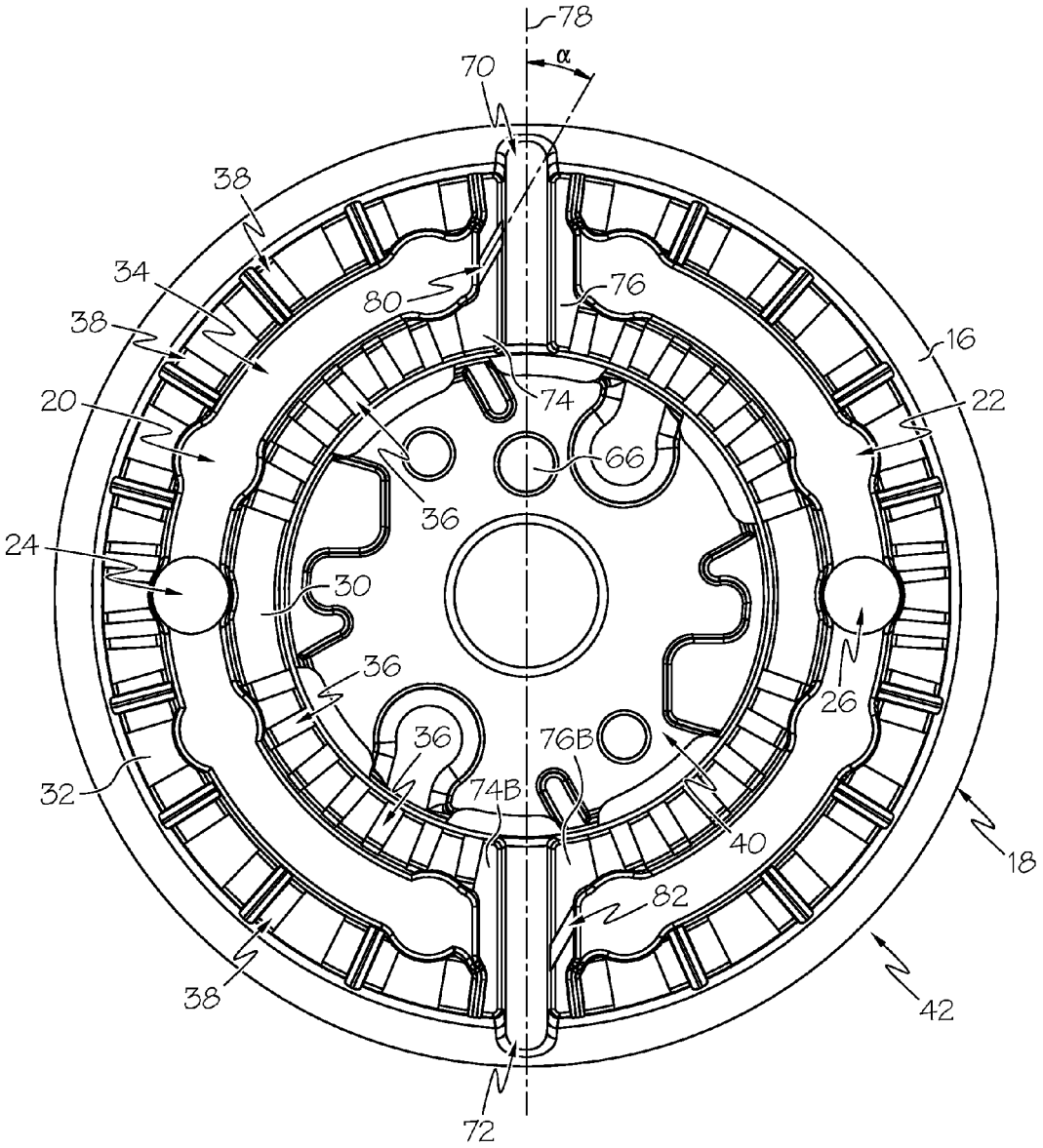
FIG. 6 is a top view of the gas burner with the burner cap removed.

Turning now to FIG. 6, the gas burner 10 can further include at least one flame channel configured to trigger ignition of at least one of the inner and outer flame rings. In one example, the gas burner 10 can include a plurality of flame channels 70, 72 disposed between the first and second combustion chambers 20, 22. For example, each flame channel 70, 72 can provide a separation between the combustion chambers 20, 22. One the of the flame channels 70 will now be described in detail, with the understanding that such description can also apply to any other flame channel. Still, any of the flame channels can be identical, similar, or even different.

Each flame channel 70 can be defined by opposing side walls 74, 76 extending along a channel axis 78. Any or all of the side walls 74, 76 can be generally parallel to the channel axis 78, or can even be angled or curved relative thereto. Each of the side walls 74, 76 can be a portion of the combustion chambers 20, 22, such as forming a connecting wall, between the inner and outer walls 30, 32 thereof. Thus, as shown, each of the first and second combustion chambers 20, 22 can be defined by the inner wall 30, outer wall 32, and at least one side wall of an adjacent flame channel 70. For example, as shown, one side wall 74 of the flame channel 70 and one side wall 74B of the flame channel 72 can be formed with the first combustion chamber 20, while the other side walls 76, 76B of the flame channels 70, 72 can be formed with the second combustion chamber 22.

Various numbers and configurations of flame channels 70, 72 can be provided, and may be based upon the configuration, number and arrangement of the plurality of combustion chambers. In one example, the plurality of flame channels 70, 72 can be arranged in an opposed manner such that the respective channel axes are substantially coaxial. For example, as shown, the spacing of the flame channels 70, 72 can facilitate generally equal placement of the combustion chambers 20, 22 about the gas burner 10. In another example, the channel axis 78 of each flame channel 70 can be arranged substantially transversely to the outer flame ring, or can be curved and/or angled relative thereto.

Additionally, at least one transfer burner port can be provided to at least one flame channel. In one example, a plurality of transfer burner ports 80 can be provided with at least one transfer burner port 80 extending through at least one side wall 74 of each of the plurality of flame channels 70, 72. Thus, each flame channel 70, 72 can be provided with at least one transfer burner port 80, 82. As shown, one flame channel 70 can include one transfer burner port 80 extending through one side wall 74, while the other flame channel 72 can similarly include one transfer burner port 82 extending through one side wall 76B. Still, it is understood that each flame channel can be provided with various numbers of transfer burner ports extending through some or all of the side walls thereof. Further, the transfer burner ports can have various structure and/or configurations as previously described with respect to the burner ports 36, 38.

In addition or alternatively, each transfer burner port 80 can be arranged at an angle $\alpha$ relative to the respective channel axis 78 and/or a respective side wall 74. In one example, the transfer burner port 80 can be arranged generally perpendicular relative to the channel axis 78 and/or side wall 74. In another example, as shown, the transfer burner port 80 can be arranged at an angle α relative to the respective channel axis 78 and/or side wall 74 so as to position an outlet of the transfer burner port 80 relatively closer to the outer combustion zone 42 (outer flame ring) than the inner combustion zone 40 (inner flame ring). Alternatively, the transfer burner port 80 can be arranged at another angle (not shown) relative to the respective channel axis 78 and/or side wall 74 so as to position an outlet of the transfer burner port 80 relatively closer to the inner combustion zone 40 (inner flame ring) than the outer combustion zone 42 (outer flame ring). It is understood that any or all of the transfer burner ports 80, 82 can have identical, similar, or even different configurations.

Each of the transfer burner ports 80, 82 is in gas-flow communication with the combustible gas in a respective one of the first and second combustion chambers 20, 22 and is configured to trigger ignition of the outer flame ring. In one example, transfer burner ports 80 are configured to trigger ignition of the outer flame ring subsequent to the ignition of the inner flame ring. For example, the igniter 66 ignites the gas escaping from at least some of the inner burner ports 36. The ignition process progresses through the flame channels 70, 72 and ignites the gas escaping from the transfer burner ports 80, 82. Finally, the flames of the transfer burner ports 80, 82 reach at least some of the outer burner ports 38. Meanwhile, the remaining inner and outer burner ports 36, 38 continue to ignite in a progression around the inner and outer flame rings of the inner and outer combustion zones 40, 42. With this feature, the design is able to reduce, such as eliminate, a need for a separate flame ignition device for lighting the outer flame ring. Alternatively, the design can be reversed. For example, the igniter 66 can ignite the gas escaping from at least some of the outer burner ports 38. The ignition process can progress through the flame channels 70, 72, ignite the gas escaping from the transfer burner ports 80, 82, and finally ignite reach at least some of the inner burner ports 36.

Figure 3:
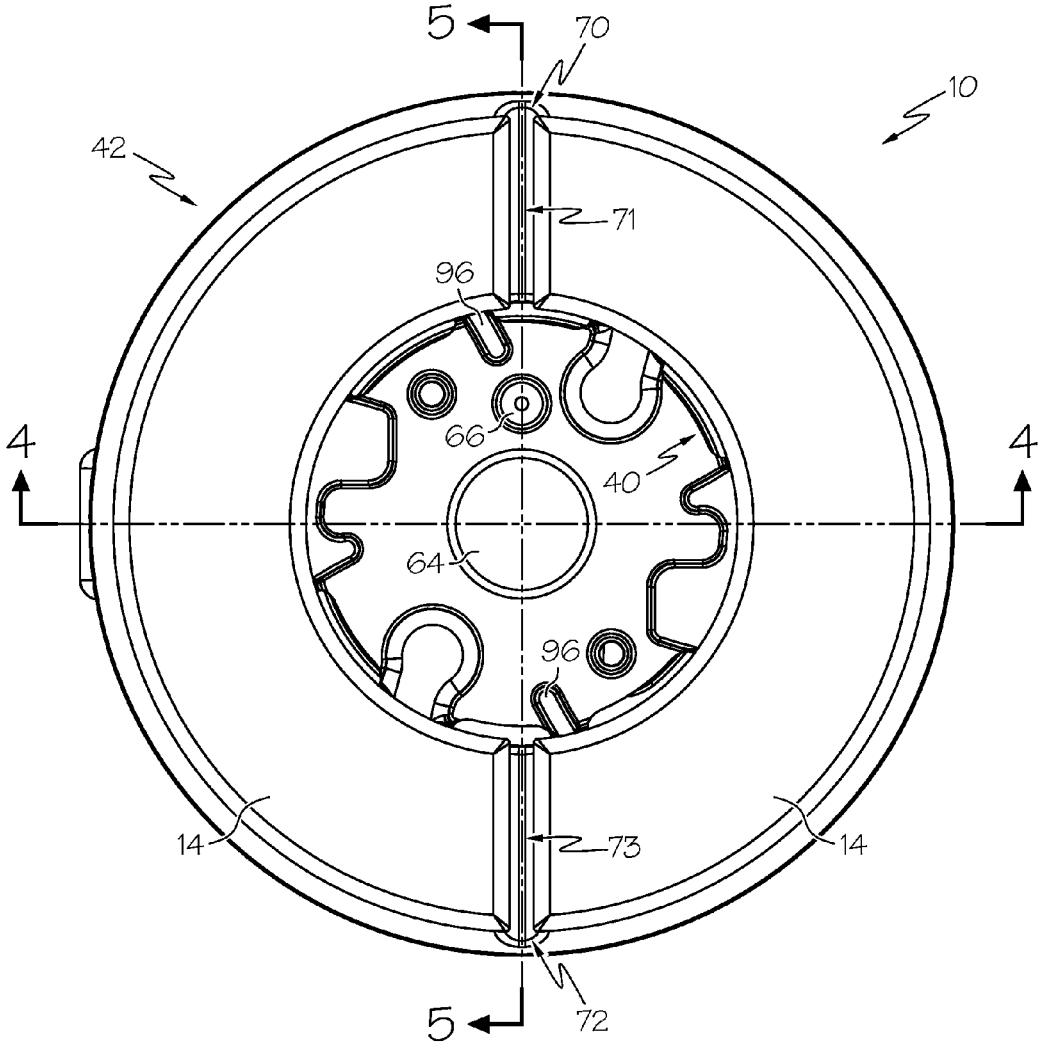
FIG. 3 provides a top view of the gas burner.

In addition or alternatively, some or all of the burner caps 14 can extend a distance over the flame channels 70, 72 in an at least partially covering relationship, as shown in FIG. 3. However, the burner caps 14 can still provide an upper opening 71, 73 for the flame channels 70, 72. For example, the upper opening 71, 73 can be provided by a separating gap between adjacent burner caps 14, or an be an aperture or the like extending into or through one or more burner caps 14. This structure can help flame carry-though towards the outer flame ring while reducing, such as eliminating, flame flash during ignition. Conventionally, ignition of an outer flame ring can cause a visual flame flash and/or audible flame "poof," which can be disconcerting to a user. However, the described structure herein can reduce, such as eliminate, these effects while providing a relatively quiet and seamless burner ignition.

The gas burner 10 can include additional features. In one example, the gas burner 10 can include a simmer burner 64. In one example, the simmer burner 64 can be separate from the first and second combustion chambers 20, 22 and that is independently supplied with combustible gas via a third gas supply, though could also share a gas supply. The simmer burner 64 can be formed together with the burner body 16, or can be coupled to the burner body 16 in various manners, such as by a clip ring 84 or in various other removable or non-removable manners. In another example, the simmer burner 64 could be coupled to or formed with the mounting base 12. The simmer burner 64 includes at least one simmer burner port 86 forming a simmer flame. In the shown example, the simmer burner 64 can include a plurality of simmer burner ports 86, such as two or four or more, arranged generally equally around the perimeter thereof. The simmer burner ports 86 can have various structure and/or configurations as previously described with respect to the burner ports 36, 38. In general, the simmer burner ports 86 are configured to output a relatively small flame ring with relatively less heat output as compared to the inner flame ring. The simmer flame ring can be generally concentric with the inner flame ring, and can have a relatively smaller diameter. The simmer burner 64 can also include a removable or non-removable simmer burner cap 88 arranged in covering relationship over the simmer burner port(s) 86.

Figure 5:
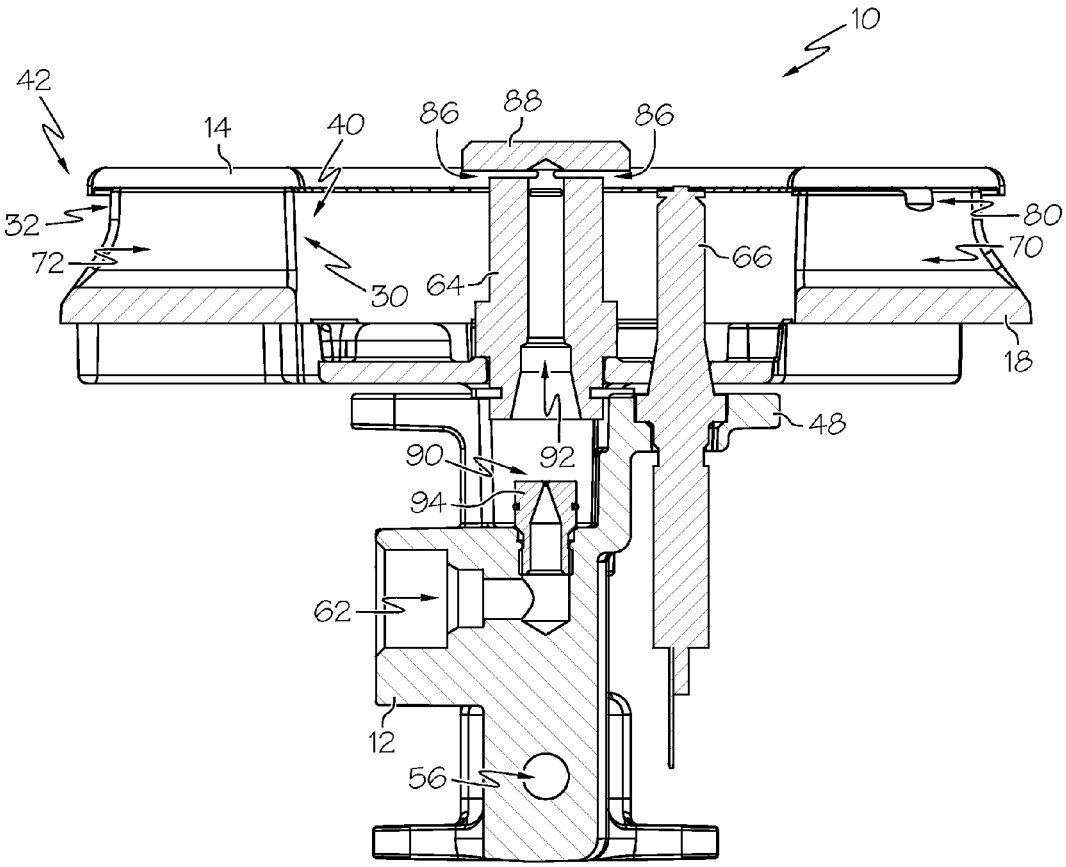
FIG. 5 provides a sectional view taken along line 5-5 of FIG. 3 of the gas burner.

As shown in FIG. 5, the mounting base 12 also includes a gas supply port 90 positioned and sized near a gas entry tube 92 (which can be a Venturi tube) of the simmer burner 64. For example, the gas supply port 90 can be provided with a nozzle 94 to direct the gas into the gas entry tube 92. The gas supply port 90 can be in fluid communication with a second gas supply plenum 62 provided in the mounting base 12 that receives the gas from the gas supply 58 (e.g., a gas line, etc.) via the adjustable dual-output valve 60. For example, the dual outlet gas valve 60 can allow a relatively less amount of gas flow to the simmer burner 64 such that relatively low flames are provided by the simmer burner 64 in several alternative modes of operation. Still, it is understood that the gas supply to the simmer burner 64 can also be provided and controlled by a separate and independent valve and/or gas supply.

Additionally, the electric igniter 66 can be disposed between the simmer flame ring and the inner flame ring, and can be configured to ignite either or both of the simmer flame and inner flame ring. Thereafter, the transfer burner ports 80, 82 can be configured to trigger ignition of the outer flame ring subsequent to the ignition of the simmer flame and/or the inner flame ring.

The dual outlet gas valve 60 can be configured to provide various modes of operation. In one example mode of operation, the valve 60 can initially provide gas only to the simmer flame ring such that the simmer flame ring is the only one ignited. Subsequently, the user could selectively provide gas flow the to the inner and/or outer flame rings (i.e., for activation) upon further adjustment of the valve 60. In another example mode of operation, the valve 60 can initially provide gas to each of the simmer flame ring, inner flame ring and outer flame ring such that substantially all of the flame rings are initially ignited. Subsequently, the user could selectively reduce, such as stop, gas flow to the inner and/or outer flame rings (i.e., for deactivation) upon further adjustment of the valve 60. In addition or alternatively, the respectively burner ports 36, 38, 80, 82, 86 can be designed to provide staged gas flow to each of the simmer flame ring, inner flame ring and outer flame ring is based upon a predetermined amount of gas (e.g., volume flow, mass flow, etc.) consumed by each flame ring. For example, gas flow can be initially provided to the simmer flame ring up to a predetermined amount consumed, whereby excess unburned gas can then flow to the inner flame ring up to a predetermined amount consumed, whereby the remaining unburned gas can then flow to the outer flame ring (and transfer burner ports 80, 82), or vice-versa. The predetermined amount consumed can be a maximum amount consumable by each flame ring, or other desired amount.

Thus, the gas burner 10 can provide a wide range of burner turndown ratio's based upon selective activation or deactivation of the simmer flame ring, inner flame ring, and outer flame ring. For example, the simmer flame ring can provide as little as about 150 British thermal units (BTU's). In another example, the inner flame ring can provide as little as about 450 BTU's up to about 700 BTU's. In yet another example, the outer flame ring can provide as little as about 1,500 BTU's up to about 18,000 BTU's. Thus, the gas burner 10 can provide a turndown ratio (i.e., maximum BTU output versus minimum BTU output) of about 40:1 (i.e., 18,000 vs. 450) without the simmer burner 64, or even of about 120:1 (i.e., 18,000 vs. 150) with the simmer burner 64. The described turndown ratio can be selectively adjustable by a user upon adjustment of a single valve 60 as described herein.

The gas burner 10 can include yet additional features. For example, as shown in the bottom view of FIG. 7, a plurality of vanes 96 can be positioned on the bottom side 19 of the burner body 16 and can extend towards the inner flame ring (e.g., towards the inner combustion zone 40). The plurality of vanes 96 can be coupled to or formed with the burner body 16, and can be angled relative to the inner flame ring. In one example, the vanes 96 can be angled or curved, such as with a generally constant diameter or even to form a portion of a spiral pattern. Generally, a spiral is a curve which emanates from a central point, getting progressively farther away as it revolves around the point. By a portion of a spiral, what is meant is that the vanes 96 are curved so that a spiral having that angle of curvature could be overlaid thereon. Providing angled and/or curved vanes 96 can help to swirl the incoming air supply (e.g., oxygen for combustion) when it enters the inner combustion zone 40 for feeding the simmer flame ring and/or inner flame ring.

Figure 7:
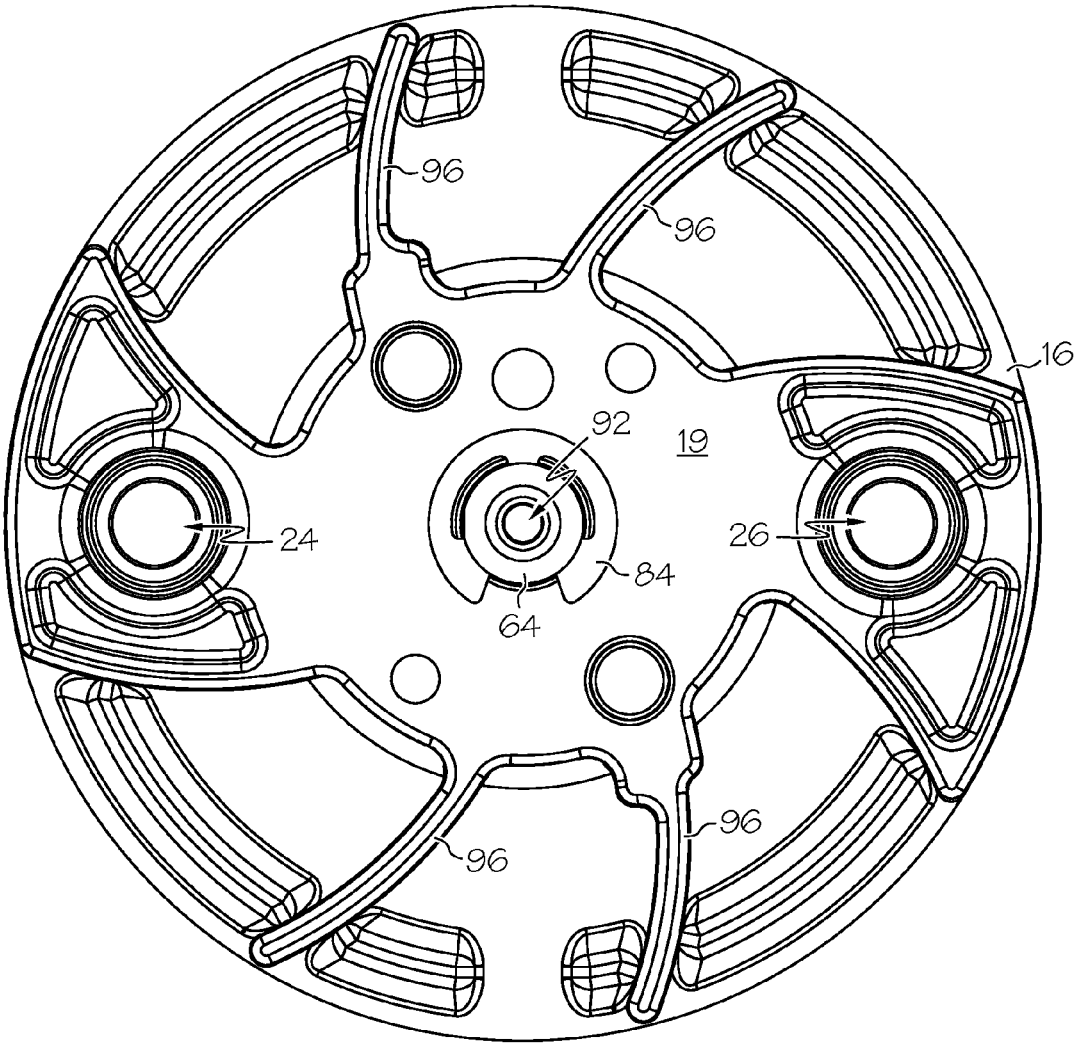
FIG. 7 is a bottom view of the gas burner.

The vanes 96 are designed to help impart a swirling motion on air as it enters the inner combustion zone 40 where it mixes with the gaseous fuel therein from the simmer burner ports 86 and/or the inner burner ports 36. Air is drawn into the inner combustion zone 40 by convection, as a result of the operation of the gas burner 10. The vanes 96 can have a variety of shapes that are suitable for redirecting airflow. For example, the vanes 96 can be oblong rectangular strips or beams as shown in FIG. 7. One portion of the vanes 96 can be coupled to the bottom side 19 of the burner base 18, while another end of the vanes 96 extends into a portion of the space below the inner combustion zone 40. The number and configuration of vanes 96 used can vary in different embodiments of the invention. For example, about 4-10 vanes can be used. Still, vanes 96 that are not angled or curved can also be used to guide the air flow.

The gas burner 10 is generally provided on the surface of a cooking appliance (e.g., cooktop, range, etc.). Generally, the burner body 16 and the burner cap 14 are positioned above the cooktop, whereas the mounting base 12 is not visible and is attached below the cooktop. The mounting base 12 is attached to the appliance using screws or other connective devices that run through attachment points of the mounting base 12 and the cooktop.

Embodiments of the gas burner 10 can provide improved aesthetics and avoid trapping spillage within the cooking appliance. For example, embodiments of the gas burner 10 can provide a burner system that provides no top surface openings that could allow spillage to drain through the gas burner 10 into the cooking appliance or burner components. The gas burner 10 is made resistant to spillage by providing a burner cap 14 that fits over the burner body 16, resulting in a gas burner 10 that has no holes near the surface of the burner oriented in a direction that can trap spillage. This also improves the aesthetics of the cooking appliance by providing a gas burner 10 with a smooth uninterrupted surface.

Embodiments of the gas burner 10 can also provide a gas burner 10 that includes components that can be readily removed from the cooking appliance for cleaning. For example, the burner cap 14 can simply be lifted off of the burner body 16 and cleaned. The burner body 16 can also be easily removed from the mounting base 12 for cleaning. Cleaning can be carried out using typical kitchen materials, such as soap and water. The burner body 16 can be mounted to the mounting base 12 by screw attachment in which one or more screws (not shown) are run through burner mounting holes provided in the burner base 18 and into attachment points provided in the mounting base 12. Thus, in order to remove the burner body 16, one need only remove the screws used to attach the burner body 16, which can then be lifted off of the cooking appliance and cleaned. Because the gas lines are attached to the mounting base 12, the burner body 16 can be removed without disconnecting the gas lines.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A gas burner for a cooking appliance, comprising:

a burner body comprising a first combustion chamber with a first gas inlet and a second combustion chamber with a second gas inlet, the first and second combustion chambers being separate and being independently supplied with combustible gas via the first and second gas inlets, respectively, the first and second combustion chambers cooperating to form a substantially annular outer flame ring and a substantially annular inner flame ring;

an electric igniter being configured to ignite the inner flame ring;

first and second burner caps for independently closing off a top of each of the first and second combustion chambers, respectively, so as to substantially preclude the escape of combustible gas therefrom;

a plurality of flame channels disposed between the first and second combustion chambers and configured to trigger ignition of the outer flame ring subsequent to ignition of the inner flame ring; and at least one transfer burner port providing gas flow communication with the combustible gas in one of the first and second combustion chambers that is ignited within one of the plurality of flame channels by the inner flame ring, wherein the outer flame ring is subsequently ignited by the at least one transfer burner port, wherein the first and second burner caps are configured to extend a distance over the plurality flame channels in an at least partially covering relationship to at least partially retain said combustible gas within said respective flame channel, and wherein the first and second burner caps are further configured to provide an upper opening for each of the plurality of flame channels, and wherein the upper opening provides fluid communication between the flame channels and an external environment and is configured to reduce flame flash during ignition of the outer flame ring, and wherein each of the flame channels is defined by opposing side walls extending along a channel axis, and the plurality of flame channels are arranged in an opposed manner such that the respective channel axes are substantially coaxial, and wherein at least one transfer burner port extends through at least one side wall of each of the plurality of flame channels, and is arranged at an angle relative to the respective channel axis, and wherein the angle of each transfer burner port is arranged to position an outlet thereof relatively closer to the outer flame ring than the inner flame ring.

2. The gas burner of claim 1, further comprising a simmer burner being separate from the first and second combustion chambers and being independently supplied with combustible gas via a third gas inlet, the simmer burner comprising at least one simmer burner port forming a simmer flame ring.

3. The gas burner of claim 2, further comprising a mounting base coupled to the burner body, the mounting base comprising a first gas plenum with a plurality of gas outlets each aligned with one of the first and second gas inlets, and an independent second gas plenum with a simmer gas outlet aligned with the third gas inlet.

4. The gas burner of claim 1, wherein the electric igniter is disposed adjacent to the inner flame ring.

5. A gas burner for a cooking appliance, comprising:

a burner body comprising a first combustion chamber with a first gas inlet and a second combustion chamber with a second gas inlet, the first and second combustion chambers being separate and being independently supplied with combustible gas via the first and second gas inlets, respectively, the first and second combustion chambers forming a substantially annular outer flame ring and a substantially annular inner flame ring;

first and second burner caps for closing off a top of each of the first and second combustion chambers, respectively, so as to substantially preclude the escape of combustible gas therefrom; and a plurality of flame channels disposed between the first and second combustion chambers and being configured to provide an ignition process that triggers ignition of the outer flame ring subsequent to ignition of the inner flame ring, wherein after ignition of the inner flame ring, the ignition process then ignites combustible gas within the flame channels to thereby ignite the outer flame ring, wherein the first and second burner caps are configured to extend a distance over the plurality flame channels in an at least partially covering relationship to at least partially retain said combustible gas within the flame channels, and wherein the first and second burner caps are configured to provide an upper opening for each of the plurality of flame channels, wherein the upper opening is defined by a separating gap between the first and second burner caps and the upper opening provides fluid communication between the flame channels and an external environment and is configured to reduce flame flash during ignition of the outer flame ring, and wherein the gas burner further comprises a plurality of transfer burner ports with at least one transfer burner port extending through at least one side wall of each of the plurality of flame channels and being arranged at an angle relative to a longitudinal axis of the respective flame channel, each transfer burner port being in gas-flow communication with the combustible gas in one of the first and second combustion chambers.

6. The gas burner of claim 5, further comprising:

a first plurality of exterior burner ports and a first plurality of interior burner ports providing openings in the first combustion chamber through which combustible gas can pass from the first combustion chamber and be combusted; and a second plurality of exterior burner ports and a second plurality of interior burner ports providing openings in the second combustion chamber through which combustible gas can pass from the second combustion chamber and be combusted, the first and second pluralities of exterior burner ports cooperating to form the outer flame ring and the first and second pluralities of interior burner ports cooperating to form the inner flame ring.

7. The gas burner of claim 5, further comprising:

a simmer burner being separate from the first and second combustion chambers and being independently supplied with combustible gas via a third gas inlet, the simmer burner forming a simmer flame ring; and an electric igniter disposed between the inner flame ring and the simmer flame ring, and being configured to ignite at least one of the simmer flame ring and the inner flame ring.

8. The gas burner of claim 7, further comprising a mounting base coupled to the burner body, the mounting base comprising a first gas plenum with a plurality of gas outlets each aligned with one of the first and second gas inlets, and an independent second gas plenum with a simmer gas outlet aligned with the third gas inlet.

9. The gas burner of claim 1, wherein the upper opening is defined by a separating gap between the first and second burner caps.

* * * * *